US005421859A

United States Patent [19]

Wienert

[11] Patent Number: 5,421,859

[45] Date of Patent: Jun. 6, 1995

[54] PROCESSES OF CONTINUOUSLY MAKING HARD COMPOSITES OF COKE AND CARBON-REDUCIBLE OXIDES FOR SMELTING TO IRON, FERROALLOYS AND SILICON

[76] Inventor: Fritz O. Wienert, 394 Roosevelt Ave., Niagara Falls, N.Y. 14305

[21] Appl. No.: 235,961

[22] Filed: May 2, 1994

Related U.S. Application Data

[62] Division of Ser. No. 808,662, Dec. 17, 1991, abandoned.

[51] Int. Cl.[6] ..... C21B 5/00

[52] U.S. Cl. ..... 75/766; 75/746; 75/755; 75/772

[58] Field of Search ..... 75/746, 755, 766, 772

[56] References Cited

U.S. PATENT DOCUMENTS

| | | | |
|---|---|---|---|
| 2,711,951 | 6/1955 | West | 75/766 |
| 2,711,952 | 6/1955 | West | 75/766 |
| 2,842,434 | 2/1958 | Kippe | 75/766 |
| 2,861,881 | 11/1958 | Phelps | 75/766 |
| 3,308,219 | 3/1967 | Schmalfeld | 75/766 |
| 4,039,319 | 8/1977 | Schapiro | 75/766 |
| 4,728,358 | 3/1988 | Hoffman | 75/766 |

*Primary Examiner*—Peter D. Rosenberg

*Attorney, Agent, or Firm*—Wallace F. Neyerlin

[57] ABSTRACT

Composite pieces of high density and strength are made continuously from mixtures of fine particles of bituminous or subbituminous or lignite coals and particles of carbon reducible oxides. The particles are mixed with water, compressed to squeeze out some of the water to obtain single bodies which are heat processed lying on a traveling grate on which the composites undergo drying, pyrolyzing, carbonizing and cooling.

A modification includes mixing in with the coal material(s) listed above, coke fines or char or anthracite coal. The carbon reducible oxides utilized are such as the oxidic ores of Fe, Mn, Cr and quartzite in recited important proportions that make the formed composite bodies usable in a submerged arc furnace or in a low shaft blast furnace or in an open hearth to produce desired intermediate or end metallic products such as ferromanganese, Fe-Cr base metal for stainless steel, iron, ferroalloys or silicon.

Another modification includes the incorporation of fine particles of limestone in the above composite pieces so that such pieces burn without developing $SO_2$. The incorporation is carried out by mixing the fine particles of limestone with the fine coal particles before they enter the above procedure.

14 Claims, 1 Drawing Sheet

Figure 1:
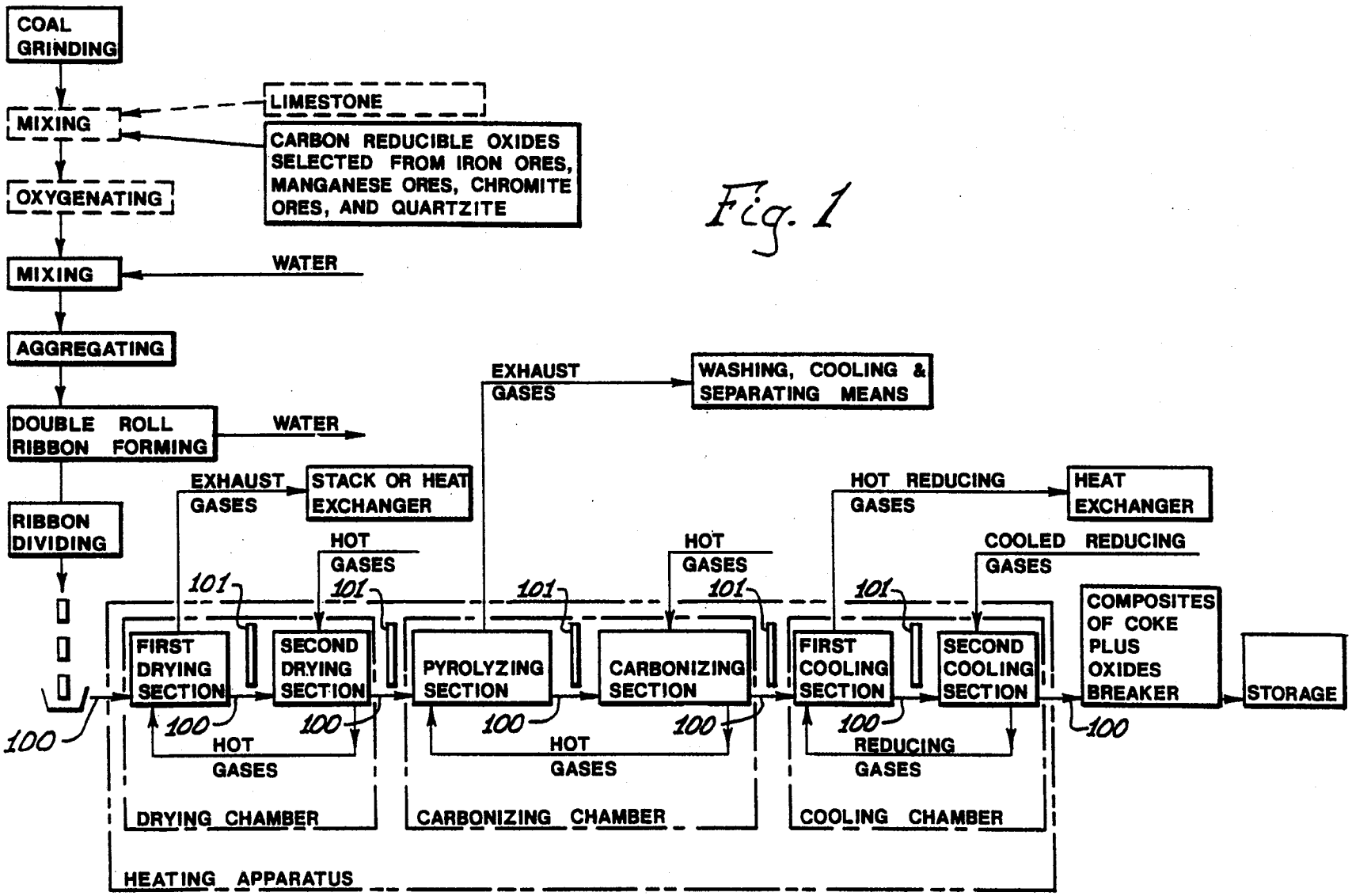

PROCESSES OF CONTINUOUSLY MAKING HARD COMPOSITES OF COKE AND CARBON-REDUCIBLE OXIDES FOR SMELTING TO IRON, FERROALLOYS AND SILICON

This application is a division of application Ser. No. 07/808,662, filed Dec. 17, 1991, now abandoned.

BACKGROUND OF THE INVENTION

The present invention utilizes a part of the technology described in the U.S. Pat. Nos. 4,419,186 and 4,613,363 both invented by the present inventor. The steps applied in the present invention relate to the compaction of fine particles and comprise mixing the fine particles with sufficient water, pressing and stirring the mixture several times to form aggregates and then compacting the aggregates under a momentary pressure in the range from about 800 to 1600 kg per sq cm whereby some of the added water is squeezed out, to a continuous ribbon about 5 cm thick. Such pressure is achieved by means of smooth double rolls. The obtained ribbon is divided into compacted moist single bodies.

SUMMARY OF THE INVENTION

Formed composites of coke plus carbon-reducible oxides of high density and strength are continuously made from mixtures of fine particles smaller than nominal about 0.2 mm of bituminous or subbituminous or lignite coals in which the contents of ash and sulfur of coke made therefrom would be suitable for use in a blast furnace and particles smaller than about 0.4 mm of one or of a mixture of carbon-reducible oxide materials selected from the group consisting of iron ores, manganese ores, chromite ores, and quartzite. The mixture of particles are then moistened, pressed by smooth double rolls, dried, pyrolyzed and carbonized up to at least 650° C. to about 750° C., and then cooled while lying on a traveling grate, and discharged from the grate into a breaker for dividing them into pieces of the desired size. The obtained pieces are self-reducing composites of coke plus oxides of high density and strength and can be used advantageously in a blast furnace for making iron or for several other uses as hereinafter described. Detailed particulars of the processing steps are also set forth hereinafter, and in the claims.

The hard pieces of coke composites containing fine particles of carbon-reducible oxides are self-reducing, when they are heated in a submerged arc furnace, as quasi-solid state reactions lead to the reduction of the oxides before any fusion occurs. Subsequent melting produces iron or ferroalloys or silicon respectively. The power consumption is considerably lower than in the prior art of feeding pieces of the oxides and of the reducing carbon. Furthermore, the top gases of the arc furnace are clean enough to be utilized.

In another embodiment, the hard self-reducing pieces of the composites of coke and carbon-reducible oxides are fed into a low-shaft blast furnace fired by the partial combustion of coal dust and/or fluid fuel. The resulting melts are the same as those tapped from the submerged arc furnace. The hot iron may be converted to a high grade of carbon steel free of any harmful contaminants in an oxygen converter. Liquid ferrochrome with about 20% Cr is converted in an oxygen converter to 18-8 stainless steel.

Still another modification comprises charging the hard self-reducing composites of coke, FeO or of coke, $FeO\text{-}Cr_2O_3$ into an open hearth, heating the charge to obtain a metal pool by a flame from injected fuel oil into the hot ash from the checkers; and by the combustion of CO and $CO_2$ and by injecting oxygen into the metal pool until the desired carbon content in the steel is obtained, or until all the carbon is removed from the stainless steel.

In other words, the open hearth makes it possible to produce carbon steel or stainless steel directly although in a less economical way than via the low shaft blast furnace and oxygen converter.

The process of the invention and various modifications and features thereof are as illustrated in FIG. 1. In this Figure, numeral 100 represents a traveling grate which goes through a compartmentalized heating apparatus comprising a drying chamber, a carbonizing chamber, which consists of a first pyrolyzing section, and a second carbonizing section, and a cooling chamber. Numeral 101 depicts separating aprons, variously located in the compartmentalized heating apparatus. Labeled boxes with dotted lines denote process alternatives.

For ease of description the present invention is separated into 3 parts.

The starting material of the present process are any type of bituminous, subbituminous or lignite coals or mixtures thereof, provided the ash and sulfur contents are tolerable so that a most favorable source of carbon can be selected and in which the contents of ash and sulfur of coke made therefrom would be suitable for use in a blast furnace.

Making the various coals and mixtures thereof suitable for the present processes is based partially on the discovery that the selected coal or mixtures thereof must be divided into particles smaller than about 0.2 mm.

It was found that a small amount of a transient liquid phase is formed in the composites made according to the present process when the composites pass through the temperature range of 350° to 475° C. and that the composites begin to shrink and that shrinking continues with rising temperatures and that the rate of shrinking increases when the temperature rises slower. Such favorable heating rate is realized by the use of an endless traveling grate which also serves for drying the moist compacted composites and finally for cooling the produced self-reducing composites of coke plus oxides of high density and strength.

The traveling grate goes through a compartmentalized heating apparatus comprising a drying chamber, a carbonizing chamber consisting of a first pyrolyzing section, and a second carbonizing section and a cooling chamber. These chamber(s) and/or sections may be subdivided as hereinafter indicated.

The procedure is as follows: The moist compacted composites are placed on the traveling grate to form a bed at least 30 cm deep. The bed moves with the grate under a horizontal bar hanging horizontally by means of chains from a stationary support so that the bar equalizes the depth of the bed. Then the moving bed enters the drying chamber, passing under an apron made of flexible material and hanging down from the ceiling of the drying chamber to let its edge slide on the surface of the bed, thus preventing the escape of gases from the drying chamber. After grate and bed have traveled about 5 minutes there is another apron dividing the first from the second section (Section 2) of the drying chamber. Under each section there is a bin receiving the gases coming down through the bed or directing the gases to flow upwards through the bed.

For drying the bed, combustion gases of fluid fuel coming from an oven are introduced above the bed in the first section and are drawn through the bed into the bin and from there into a duct leading to a centrifugal fan blower which blows the gases into the bin under Section 2 by flowing upwards through the bed and finally to the exhaust of the Section 2 leading to a stack or to a heat exchanger. Bed and grate move through the second section where it is heated in about 10 minutes whereby the bed must not be heated to higher than about 220° C. (A higher temperature would cause pollution and would also adversely affect the quality of the end product.) Then the bed on the grate and grate pass another apron and enter the pyrolysis (first) section of the carbonization chamber in which the bed is heated to about 500° C. for the pyrolysis in at least about 25 minutes by the gases from the second section of the carbonization chamber blown upwards through the bed and exhausted into a washer-cooler, as is applied in connection with a slot coke oven, so that hydrogen sulfide is removed and the condensed volatile matter is separated from the clean gas.

Grate and bed leaving the pyrolysis section pass another apron and enter the carbonization section of the carbonizing chamber in which the bed is heated in at least 25 minutes from about 500° to at least between 700° and 750° C. by the gases of the combustion of a fluid fuel in a separate oven. These gases are introduced into the section above the bed at the end of the section and are drawn through the bed downwards into the bin and from there into a centrifugal blower which blows them into the bin of the first section and moves the gases upwards through the bed as described above.

After about 25 to 30 minutes in the carbonization section, the shrunken composites on the grate pass under an apron and enter the cooling chamber which is filled with a reducing gas and is divided into two sections. The reducing gas being colder than 200° C. is moved from a heat exchanger to flow downwards through the bed of the coke bodies in the second section and upwards through the bed of the first section and then to the heat exchanger and finally back to the second section. The composite bed colder than about 200° C., leaves the cooling chamber under an apron and is discharged from the grate into a breaker to obtain pieces of the desired size.

It is to be noted that the present process does not involve any inherent pollution.

More specific aspects of the various parts of the present invention are provided by the Examples which follow.

EXAMPLES

Optimal processing conditions must be determined empirically; however, doing this on the scale of production involving a traveling grate would be cumbersome and costly. Therefore, it was carried out in the laboratory by simulating the events on the traveling grate by preparing compressed moist composite cylinders one at a time, exposing the moist cylinder lying in rest to the heating rates and the compositions of the surrounding gas as during the same time periods referred to above as each compressed composite body would encounter them on its way within the traveling grate heating apparatus and system.

PART 1

Making Hard Composites Of Coke—Carbon-Reducible Oxides For Smelting To Iron, Ferroalloys and Silicon In A Submerged Arc Furnace

BACKGROUND

The U.S. Pat. No. 4,613,363 of the present inventor described the making of moist compacted bodies as the precursor of self-reducing coke composites with carbon-reducible oxides. These moist bodies were immediately fed into a submerged arc furnace in which they were dried and carbonized before melting. This prior art has a number of drawbacks, for instance, water and volatile matter condensed in the colder parts of the burden and tended to cause hanging and the formation of bridges which lead to an irregular descent of the burden into the smelting zone and thus to fluctuations of the compositions of the tapped products, and to a higher power consumption. Furthermore, the top gases of the furnace were a mixture of carbon monoxide, volatile matter of the coal, smoke and fumes so that it is difficult and often not profitable to recover the carbon monoxide. All the drawbacks are overcome by the present invention.

Brief Description Of Making Hard Self-Reducing Composites Of Coke—Carbon-Reducible Oxides For Smelting In A Submerged Arc Furnace In this process the moist compacted bodies made according to the present invention are not fed into the submerged arc furnace but are placed onto a traveling grate to form a bed which is at least 30 cm deep as for making high density coke of my pending parent application, U.S. Ser. No. 07/808,662, filed Dec. 17, 1991. The same heat treatment and cooling as for coke are also applied to the moist composites so that coke carbon-reducible oxide composites are obtained.

As in the case of making high density coke, the conditions for obtaining hard coke composites were investigated by simulating the events on the traveling grate as described before in reference to making coke.

It was found that the oxygenation of the coal particles as practiced to make the high density coke must be omitted because of the high proportion of the oxide particles. It was also found that particles of the oxide materials and of the slag forming additives smaller than 0.4 mm improve the strength of the final coke composites and that superfines, that is, sizes smaller than about 5 microns should be absent when the moist compressed bodies are made. The moist compacted composites are not charged into a submerged arc furnace as in the prior art of the present inventor but they are placed on a traveling grate and treated on it as described above in reference to coke of high density. The obtained pieces of hard self-reducing composites of coke and carbon-reducible oxides are then charged into a submerged arc furnace and smelted to iron, ferroalloys or silicon respectively.

Specific data are reported in the following examples.

EXAMPLE 1

Making Self-Reducing Coke-FeO Composites For Smelting To Iron In A Submerged Arc Furnace In order to facilitate the comparison with prior art and related processes, the starting materials for this Example 1 are calculated in reference to 1000 kg of liquid iron with 95% Fe, 2% Si, and 3% C. Then the 950 kg of Fe require 1746 kg of an iron ore with 57% Fe. Assuming that the losses in the process are balanced by the Fe content in the applied coal, the 950 kg of Fe are obtained by the reduction of 1249 kg of FeO by 204 kg of C. The 20 kg of Si require 17 kg of C and the carburisation of the liquid iron requires 30 kg of C. Altogether 251 kg of C must be contained in the pieces of the self-reducing coke composites as made by the application of the traveling grate process of the present invention and are introduced at the start of this example in the form of particles smaller than nominal about 0.2 mm of a subbituminous coal containing 55% fixed carbon and 35% volatile matter. However, it was found that the pyrolysis of the coal particles within the compacts over a prolonged period of time forms about 3% additional carbon so that said coal introduces 58% effective carbon and the above 251 kg of C are brought in by 433 kg of said subbituminous coal. Furthermore, 250 kg of limestone in particles smaller than nominal about 0.4 mm are required. In summary, the starting materials for 1000 kg of liquid iron are: 1746 kg of fine iron ore with 57% Fe, 433 kg of fine subbituminous coal with 58% effective carbon and 250 kg of fine limestone. On the credit side are the major parts of the condensed volatile matter and of the cleaned off-gas from the traveling grate and the top gas from the arc furnace. The power consumption is estimated to amount to 1400 kwh. It must be noted that the produced iron is free of tramp elements which are contained in ordinary scrap.

For the simulation of the heat-treatment on the traveling grate, a single moist compact was made, as in previous examples, from 1/250,000 fractions of each of the above starting materials. Accordingly, 1.73 g of said subbituminous coal in particles smaller than 0.2 mm (without any oxygenation), 6.98 g of said iron ore with 57% Fe in particles smaller than 0.4 mm and 1 g of limestone in particles smaller than 0.4 mm were mixed. The mixture weighing 9.71 g was mixed with sufficient water, mulled to densified aggregates which were compressed under a momentary maximum pressure of 1300 kg per sq cm to a moist cylinder weighing 10.78 g. It was placed into the silica tube used before for the simulation of the traveling grate. Therein it was dried, pyrolyzed and carbonized up to 700° C. Then the obtained self-reducing coke composite was not cooled for the transfer to the submerged arc furnace but was left in the silica tube and heated further in 40 minutes to about 1000° C. thus imitating the rise of temperature when the cylinder descends somewhat deeper in the arc furnace. Then the heating was terminated and the cylinder was cooled in the reducing atmosphere to below 100° C.

It was found that the part of the cylinder which had been touched by the piston during the compression was swollen and that the degree of swelling decreased gradually with the distance from the face previously touched by the piston so that the swelling changed to shrinking in a distance of about 20 mm. The remaining length of the cylinder had shrunk to a considerable degree. Both parts of the cylinder were completely metallized. As it is known that certain iron ores and pellets of iron oxides swell when they are reduced by hydrogen it is assumed that this was also the case in this example. The hydrogen is apparently the residual quantity released from the coke at the higher temperature. The higher momentary pressure near the piston is apparently the reason for the swelling which is not desired as it may hinder the even descent into the melting zone and changes the consumption of carbon.

EXAMPLE 1.1

The lower momentary maximum pressure of 1000 kg per sq cm was applied in this example. It was the only change in regard to Example 1. The obtained moist cylinder was heat-treated in simulation of the traveling grate up to 700° C. The resulting hard self-reducing coke composite was left in the silica tube for the simulation of the descent in the submerged arc furnace. As in Example 1, it was heated in the reducing atmosphere up to 1000° C. in about 40 minutes to provide not only the sensible heat but more importantly, the endothermic reduction heat. Then the heating was terminated and cooling was undertaken until the now metallized cylinder had a temperature lower than about 100° C. The cylinder had shrunk considerably and uniformly to a cylinder which was completely metallized due to quasi-solid-state reactions. The cylindrical shape confirms that the higher pressure of 1300 kg per sq cm in Example 1 was responsible for the swelling of a part of the cylinder.

EXAMPLE 1.2

Higher Heating in Simulation of the Submerged Arc Furnace

In practice, higher heating means a deeper descent of the burden into the submerged arc furnace. In this simulation the self-reducing coke composite identical with that of Example 1.1 was heated in the reducing atmosphere of the silica tube up to 1200° C. in about 45 minutes. Then the cylinder was cooled to below 100° C. and taken out of the silica tube. It had shrunk uniformly and showed signs of the beginning of fusion as metallic beads had oozed out to the surface. When such bodies are heated further in the submerged arc furnace the fluidity of the slag increases so that globules of iron and slag drop into the molten slag covering the iron pool which is heated to the tapping temperature by the electric resistance of the slag between the feet of the arcs. The new material is quickly mixed and heated to the high temperature so that the equilibrium between slag and iron is approached rapidly. Therefore, the concentration of Si is low. Iron and slag are tapped and separated in a known manner. The iron being free of tramp elements can be used for the production of a high-grade steel.

On the credit side in favor of the present process stands the heating value of the unused portion of the condensed volatile matter and of the cleaned off-gas from the traveling grate and of the top gas from the submerged arc furnace which contains the carbon monoxide developed by the reduction of FeO and the residual hydrogen from the coke composites.

Another important advantage of the present process is that the solid state reduction prevents the formation of a slag rich in FeO which corrodes the lining of the furnace as happens in the prior art of feeding pieces of iron ore or pellets and pieces of the reductants and of the slag-forming additives into the submerged arc furnace.

Still another advantage is that making the composites of coke and FeO does not require electric power for heating. The even consumption of power in the arc furnace improves the power factor. For all these reasons it was estimated that the power consumption per 1000 kg of liquid iron is about 1400 Kwh.

EXAMPLE 2

Making Hard Self-Reducing Coke-FeO, MnO Composites for Smelting To Standard Ferromanganese in a Submerged Arc Furnace The desired composition of the standard ferromanganese is: 75% Mn, 19% Fe, less than 2% Si, and 7% C. The source of manganese is preferably a soft ore which is usually available at a discounted price. Such an ore was selected for this example. It contained 44.55% Mn, 12.02% available oxygen, 3.31% Fe, 5.38% $SiO_2$, 15% $Al_2O_3$. The starting materials for 1000 kg of standard ferromanganese must contain 750+3% losses equal to 773 kg of Mn contained in 1773 kg of said ore. This amount introduces also 54 kg of Fe so that 190−54=136 kg of additional Fe must be provided in the form of an iron ore. If the selected ore contains 57% Fe then 230 kg of this ore are required. Another starting material is 336 kg of fine limestone.

The required amount of coal can be calculated as follows: The 750 kg of Mn require 164 kg of C for the reduction of MnO. The 190 kg of Fe require 40.8 kg of C for the reduction of FeO. The 20 kg of Si require 17.1 kg of C for the reduction of $SiO_2$. The carburization of the liquid alloy requires 70 kg of C. Altogether 281.9 kg of C are needed. This amount is introduced by 485 kg of a subbituminous coal with 57% effective carbon. In summary, the starting materials for 1000 kg of liquid standard ferromanganese are: 1773 kg Mn-ore with 44.55% Mn and 3.31% Fe in particles smaller than 0.4 mm, 239 kg of an iron ore with 57% Fe in particles smaller than 0.4 mm, 336 kg limestone with 95% $CaCO_3$ in particles smaller than 0.4 mm, and 495 kg of a subbituminous coal with 57% effective C in particles smaller than 0.2 mm. The power consumption per 1000 kg of liquid standard ferromanganese was estimated to amount to 1430 Kwh.

The strength of the self-reducing coke composite was determined as before by mixing 1/250,000 fractions of the starting materials listed above, mixing the mixture with sufficient water, densifying the moist mixture to aggregates, compressing the aggregates under a momentary maximum pressure of 1400 kg per sq cm. The resulting moist cylinder was placed into the silica tube for the simulation of the heat-treatment on the traveling grate. The heating rate was the same as in Example 1 up to 700° C. Then the cylinder was cooled in the reducing atmosphere to less than about 100° C. and taken out of the silica tube. The obtained self-reducing coke composite had shrunk well and was hard. Therefore, in practice such composites will be well suitable to be fed into a submerged arc furnace.

For the simulation of such smelting, the above self-reducing composite was put back into the reducing atmosphere of the silica tube and heated to about 750° C. in 5 minutes and further to about 1100° C. in 40 minutes. After cooling to less than 100° C. the reduced composite was taken out of the tube. The cylinder had shrunk considerably and evenly in all three dimensions. In other words, such composites are heat stable and shrink up to the fusion, although the maximum momentary pressure for compacting the moist cylinder had been 1300 kg per sq cm.

EXAMPLE 3

Hard Self-Reducing Coke Composites For Smelting To Fe-Cr Base Metal for Stainless Steel in a Submerged Arc Furnace The objective of this mode of the present process is making liquid ferro-chrome to be the base metal for 18-8 stainless steel. The base metal for said 18-8 steel contains about 20% Cr, 75% Fe, less than 2% Si, and 3% C. The required starting materials are calculated in the following for the production of 1000 kg of liquid base metal. Therefore 206 kg of Cr are required if a loss of 3% of the Cr is assumed later. As source of Cr, fine Transvaal chromite ore was selected. It contained 26% Cr and 28% Fe. The above 206 kg of Cr require then 792 kg of Transvaal ore in particles smaller than about 0.3 mm, which amount also contains 28% Fe=222 kg Fe. As 772 kg Fe are required, the missing 550 kg of Fe must be provided by an iron ore. A concentrate with 64.1% Fe was selected so that 850 kg of said ore in particles smaller than about 0.3 mm are needed. For forming the slag 200 kg of limestone with 95% $CaCO_3$ in particles smaller than 0.4 mm are required.

The amount of the starting subbituminous coal is precalculated from the composition of the 1000 kg of the base metal. These 1000 kg contain 206 kg of Cr. Its reduction from $Cr_2O_3$ requires 70 kg of C. The 750 kg of Fe require 161 kg of C for the reduction of FeO to Fe. The reduction of $SiO_2$ to 20 kg of Si requires 17 kg of C. The carburization of the liquid base metal requires 30 kg of C. Altogether 278 kg of C are necessary in the self-reducing coke composites when they are smelted to the base metal. These 278 kg of C originate from 488 kg of a subbituminous coal containing 57% effective carbon when used as starting material.

In summary, the starting materials are: 792 kg of Transvaal chromite ore with 26% Cr and 28% Fe, 850 kg of said iron ore with 64.1% Fe and 200 kg of said limestone.

For simulating the heat-treatment on the traveling grate 1/250,000 fractions of the above starting materials were mixed dry and then mixed with sufficient water, densified to aggregates which were compressed to a moist cylinder under a momentary maximum pressure of 1400 kg per sq cm. The moist cylinder was dried and carbonized and finally cooled in simulation of the traveling grate as in Example 1. The resulting cooled self-reducing coke composite was hard and well suitable on a commercial scale to serve as feed for the submerged arc furnace. The power consumption per 1000 kg of liquid base metal for 18-8 stainless steel was estimated to amount to 1600 Kwh.

The resulting liquid base metal is charged into an oxygen converter. To the charge are added: the proper amount of nickel-bearing material, pieces of compatible stainless steel scrap and granular limestone. Then the oxygen blow is started to remove the carbon in a known manner.

Hard Self-Reducing Coke $SiO_2$ Composites for Smelting to Silicon in a Submerged Arc Furnace

BACKGROUND

In the prior art of making silicon in a submerged arc furnace, pieces of quartzite and pieces of the carbonaceous reductants low in ash are charged into the furnace. The latter are carbonized to coke while volatile matter is expelled. For smelting to silicon, the coke pieces floating in the liquid $SiO_2$ react with the liquid. The melting point of $SiO_2$ is 1413° C. As the liquid $SiO_2$ provides the heat for the endothermic reduction of $SiO_2$, it must be overheated to 1800° C. and higher. At these temperatures the vapor pressure of Si, SiO and SiOC are considerable and a part of them escapes with the top gases of the furnace. The recovery of Si ranges from 72 to 78%. The top gases of the furnace, consisting mainly of the CO formed by the reduction are contaminated by volatile matter from the coal, by fumes and re-oxidized Si-compounds, so that it is not profitable to utilize the high heating value. The power consumption for 1000 kg of silicon is reported to be 13,000 Kwh. All these drawbacks are overcome by the present process.

EXAMPLE 4

Brief Description of the Present Process

The present process is characterized by the use of hard self-reducing composites of coke+$SiO_2$. The calculation of the starting materials for such composites is based on the equation $SiO_2+2C=Si+2CO$ and refers to 1000 kg of silicon. As the selected quartzite contained 98% $SiO_2$ and a loss of 3% of the $SiO_2$ is assumed, 1000 kg of Si require 2261 kg of quartzite as starting material in particles smaller than 0.4 mm. The self-reducing composites contain 857 kg of C for the reduction. This amount comes from a high volatile subbituminous coal low in ash and containing 65% effective C. Therefore, 1318 kg of this coal in particles smaller than 0.2 mm are the other starting material.

On the commercial scale both starting materials are mixed in the above proportion. The mixture is moistened and densified to aggregates as described before. The aggregates are compressed to moist compacts by a momentary maximum pressure of 1400 kg per sq cm as achieved by smooth double rolls forming a continuous ribbon about 5 cm thick and which is divided into single bodies which are heat-treated and cooled on the traveling grate and divided into pieces as described before. The resulting hard self-reducing pieces of the composites are the feed for the submerged arc furnace.

In order to show the shrinking and the strength of the pieces of the coke composites, the already described simulation of the heat-treatment on the traveling grate was applied. Accordingly, 1/500,000 fractions of the starting materials were mixed. That is, 4.5 g of said quartzite particles were mixed with 2.64 g of said coal particles. The mixture was moistened, densified and compressed under a momentary maximum pressure of 1100 kg per sq cm to a moist cylinder weighing 7.92 kg and being 38.2 mm long. After the simulated heat-treatment as on the traveling grate, the coke composite weighed 5.93 g and was 32.1 mm long and was hard.

That means, the pieces of self-reducing coke composites obtained by dividing the cooled discharge from the traveling grate are well-suited to be fed into the submerged arc furnace. If this is done on the industrial scale, the pieces are quickly heated to between 800° and 900° C. Then the heat consuming solid-state reactions begin and end with the formation of Si before its melting point of 1413° C. is reached. When the melting point is exceeded for tapping the silicon, its vapor pressure is still insignificant. Nevertheless, a loss of 3% of the silicon was assumed above. The power consumption for 1000 kg of silicon was estimated to amount to 7150 Kwh compared with 13,000 Kwh in the prior art.

On the credit side in favor of the present process can be listed the potential utilization of the heating values of the unused part of the condensed volatile matter and of the off-gas from the traveling grate and more importantly of the rather clean top-gas from the submerged arc furnace.

PART 2

Smelting Hard, Self-Reducing Coke-Oxide Composites in a Low-Shaft Blast Furnace to Iron, Ferro-Alloys or Silicon The principal feature in this modification is to replace the electrical energy consumed in the submerged arc furnace by the thermal equivalent which theoretically is 1 Kwh=860 kcal. In this connection, it may be noted that hydrogen in the fuel for the shaft furnace has no heating value as $H_2O$ cannot be formed at high temperatures in the presence of C and CO. Hydrogen leaves the shaft furnace together with the top-gas for subsequent utilization of the heating value.

The highest heat value is obtained when carbon is combusted to $CO_2$. However, flame gases with a high ratio of the partial pressure of $CO_2/CO$ oxidize. While such combustion gases pass the burden in the shaft furnace, they have no metallurgical effect on the burden because $CO_2$ cannot diffuse into the dense pieces due to its molecular size and because CO is diffusing outwards. But, in the tuyere zone the conditions are different. There, metallic pearls held together by a pasty slag are briefly exposed to $CO_2$ while they drop into the liquid slag covering the metal pool so that a small amount of the metal is oxidized but quickly reduced again by the carbon dissolved in the metal. In other words, the oxidation leads to the loss of a small amount of carbon in the form of CO. Laboratory experiments in which self-reducing coke composites of Example 1.1 were heated by radiation under a blanket of a gas mixture of 80 vol% nitrogen, 12 vol% $CO_2$, and 8 vol% CO, that is a volume ratio of 60 $CO_2$/40 CO up to about 1400° C. in about 15 minutes. It was found that 3.4% of the carbon incorporated in the self-reducing compacts for the reduction were lost. However, the experimental conditions were different from the conditions in the tuyere zone. Therefore, the loss of 3.4% is not accurate. It can be determined accurately only during the operation of the shaft furnace.

It is a feature of the present process that the lost carbon is made up by mixing the corresponding amount of coal particles smaller than 0.2 mm with those applied as starting material for the submerged arc furnace.

In another modification the carbon lost in the tuyere zone is made up by introducing the necessary amount of carbon in the form of fine grains of carbonaceous materials such as coals or coke into the tuyere zone. It is understood that both methods of making up the lost carbon may be combined.

Specific data are reported in connection with the following examples.

Making Hard Self-Reducing Coke-FeO Composites and Smelting Them In a Fuel Fired Low Shaft Blast Furnace to Iron

EXAMPLE 5

This example relates to Example 1.1 in which the starting materials for 1000 kg of iron were: 1746 kg of fine particles of an iron ore containing 57% Fe, 433 kg of fine particles of a subbituminous coal containing 58% effective carbon and 250 kg of fine limestone. The power consumption was estimated to amount to 1430 Kwh. The thermal equivalent of 1 Kwh=860 kcal is in this case 1,229,800 kcal. For the partial combustion of carbon the volume ratio of 60 $CO_2$/40 CO was selected. As 600 g of carbon generate 4783 kcal if combusted to $CO_2$ and 400 g of carbon generate 880 kcal if combusted to CO, 1 kg of carbon generates 5663 kcal if combusted in this ratio. Therefore, the above 1.0 million kcal require 176.6 kg of carbon in the form of coal dust containing 55% fixed carbon and 82% of total carbon weighing 259 kg. To the cost of the coal dust the above-named 3.4% of 433 kg=16 kg of fine particles of subbituminous coal replacing the lost carbon must be added so that the 1430 Kwh are replaced by 259 kg of coal dust from a subbituminous coal and by 15 kg of fine particles of the same coal.

In regard to the combustion air, it is understood that preheated or oxygen-enriched air may be used.

Making Hard Self-Reducing Coke-MnO, FeO Composites For Smelting to Standard Ferro-Manganese in a Low Shaft Blast Furnace

EXAMPLE 6

This example is related to Example 2 in which the starting materials for 1000 kg of standard ferromanganese were 1773 kg of a soft Mn-ore with 44.55% Mn and 3.31% Fe, 235 kg of an iron ore with 57% Fe, 485 kg of a subbituminous coal with 57% effectie carbon and 336 kg of fine limestone; 1430 Kwh were needed. The thermal equivalent is 1,229,800 kcal. As 1 kg of carbon generates 5663 kcal if it is combusted to $CO_2$/CO in the volume ratio of 60/40, then 217 kg of carbon in the form of 236 kg of coal dust from a subbituminous coal with 55% of fixed carbon and 82% total carbon was approximately needed. Assuming a loss of 4.5% in the melting zone, 22 kg of the subbituminous coal with 55% fixed carbon and in particles smaller than 0.2 mm must be mixed with the 485 kg of said subbituminous coal and with the other starting materials for this example.

Therefore, 1430 Kwh are replaced by 236 kg of coal dust and by 22 kg of coal particles smaller than 0.2 mm from the same subbituminous coal.

The procedure of making the coke composites for smelting to standard ferro-manganese in this Example 6 is the same as in Example 2. In the industrial practice the obtained pieces of self-reducing coke composites having a temperature of about 200° C. are fed into the low shaft furnace in which they descend in a countermove to ascending combustion gases coming from the tuyere zone and being mixed with carbon monoxide developed in the composites due to the reduction as in Example 5.

In simulating tests with one self-reducing coke composite, the heating was terminated at 1100° C. whereupon the cylinder was cooled to less than 200° C. and taken out into the open air for examination. The original cylinder and shrunken uniformly and considerably to a very hard metallic body. The reduction of MnO was nearly complete. When in practice the temperature rises higher than 1100° C., the fusion of the slag phase begins at about 1200° C. and at about 1250° C. globules of metal and slag begin to drop through the tuyere zone into the overheated slag. Hereby the excess of carbon is oxidized by $CO_2$. As the slag receives the globules with the completely reduced metals at an even rate, the desired content of 75% Mn and the slag low in MnO are obtained steadily in this process.

Making Hard Self-Reducing Coke Composites For Smelting to Base Metal of Stainless Steel in a Low Shaft Blast Furnace

EXAMPLE 7

This example is related to Example 3 in which the starting materials for 1000 kg of base metal for 18-8 stainless steel were: 792 kg of fine Transvaal chromite ore with 26% Cr and 28% Fe, 850 kg of iron ore with 64.1% Fe, 488 kg of a subbituminous coal with 57% carbon and 200 kg of fine limestone. The power consumption was estimated to amount to 1400 Kwh.

In this Example 7, said electric power is replaced by the thermal equivalent of 1,204,000 kcal. Furthermore, in this example the higher ratio of 70 $CO_2$/30 CO is applied so that 700 g of carbon generate 5483 kcal if combusted to $CO_2$ and 300 g of carbon generate 660 kcal if combusted to CO. Therefore 1 kg of carbon generates 6143 kcal and the above 1,204,000 kcal require 196 kg of carbon which is applied in the form of coal dust from the same subbituminous coal as used for the reduction which contains 57% fixed carbon and 82% total carbon so that 239 kg of coal dust must be partially combusted.

It was estimated that these flame gases oxidize 4.5% of the 488 kg of the starting coal in Example 3, that is 22 kg of the same fine particles must be mixed with said 488 kg in order to make up for the loss of carbon in the tuyere zone. In conclusion the 1400 Kwh in Example 3 are replaced by 239 kg of coal dust of the subbituminous coal containing 82% total carbon and by 22 kg of the same coal but in particles smaller than about 0.2 mm.

The liquid base metal and the slag are tapped from the blast furnace. The metal is separated from the slag and converted in an oxygen converter to 18-8 stainless steel as described in Example 3.

PART 3

Making Steel Directly From Hard Self-Reducing Composites of Coke-FeO in the Open Hearth

EXAMPLE 8

In this process pieces of the hard composites of coke-FeO as made according to Example 1.1 are charged into the open hearth still being hot from a previous operation and having one hot set of checkers. Fuel oil is injected into the hot air flowing from the hot checkers. When the top layer of the charge is heated to higher than 800° C., the quasi solid-state reduction of FeO begins and the developed CO emerges from the charge and is combusted to $CO_2$ in the hot air. While the combustion heat from $CO_2$ increases, the rate of fuel oil injection is decreased until the injection is stopped. When the upper part of the charge is heated to about 1100° C., the quasi solid-state reduction is finished but the CO development continues in parts of the charge having a lower temperature. The upper part being completely metallized is heated further to about 1250° C., whereby the pieces lose their shape, and at further increasing temperatures, molten iron and slag trickle down through the charge and form an iron pool covered by slag. The melting exposes the next layer directly to the radiation from the roof and causes quick melting of the pieces already heated by secondary radiation. These events continue until insufficient CO is combusted to $CO_2$ because the FeO is already reduced. Then granular limestone is charged into the hearth if the slag is not basic enough. Furthermore, pieces of iron or steel scrap free of harmful contaminations such as tramp elements are charged. However, such scrap is costly and available only in limited quantities. Therefore, it is preferred to charge as coolant, pieces of self-reducing composites of coke and FeO as used at the start of the operation.

Then oxygen is injected into the iron pool whereby the oxidation of C to CO generates heat and the subsequent combustion of CO to $CO_2$ generates more heat so that the charge, and the added coolant are melted and heated through the refining period up to the tapping temperature.

The oxygen injection is continued until the specified content of carbon is reached as it has been done in oxygen converters.

In conclusion, the above process has the potential to make a high grade steel directly.

Making Stainless Steel From Composites of Coke-Fe, Cr Oxides in an Open Hearth

EXAMPLE 9

This example is related to Example 3 in which hard pieces of self-reducing composites of coke-Fe, Cr oxides were smelted in a submerged arc furnace to ferrochrome called base metal, for the subsequent conversion to 18-8 stainless steel in an oxygen converter.

In this Example 9 the same hard pieces of self-reducing composites of coke-Fe, Cr oxides as coming from the traveling grate are charged into an open hearth and heated therein as in Example 8 by a flame of fuel oil and by the combustion of CO to $CO_2$, whereby a metal pool covered by slag is formed on the bottom of the hearth. When the quasi solid-state reduction does not supply sufficient CO anymore, then the proper amount of nickel-bearing particles and pieces of compatible stainless steel scrap and, if necessary, granular limestone are charged into the hearth, whereupon oxygen is injected into the metal pool. It oxidizes C to CO, generating heat, and emerges to above the charge and is combusted to $CO_2$ generating more heat so that the residual solid-reduced bodies, the nickel-bearing particles, the scrap of stainless steel are melted and the limestone grains are dissociated and the CaO is dissolved in the slag. Furthermore, the whole content of the hearth is heated to the tapping temperature of the 18-8 stainless steel.

The injection rate of oxygen is gradually decreased when the complete removal of carbon is approached and finally terminated. In order to decrease the loss of $Cr_2O_3$ in the slag, the known method of diluting the oxygen with argon may be used. It may be noted that refining occurs during the oxygen injection.

The above measures can be applied for making other grades of stainless steel.

Recapitulation of the Invention and of the Significance of the Examples

In my parent application Ser. No. 07/808,662, filed Dec. 17, 1991, coke of high density and strength is made continuously from a bituminous or subbituminous or lignite coals or of mixtures thereof by dividing the selected coal or coals into particles smaller than nominal about 0.2 mm, treating the divided particles with air at temperatures below about 220° C. to such an extent that the oxygenation of the coal particles leads to shrunken coke of high density and strength at the end of this process.

The coal particles, oxygenated to the predetermined optimal extent, are mixed with sufficient water and the mixture is mulled to aggregates which are compressed by smooth double rolls under a momentary maximum pressure of about 1300 kg per sq cm to a ribbon about 5 cm thick whereby a small part of the admixed water is squeezed out. The ribbon is divided into single bodies which are placed onto a traveling grate where they form a bed at least 30 cm deep. The grate carries the bed through the drying chamber in about 10 minutes and then through the pyrolyzing section and carbonizing section in at least about 50 minutes in which time the shrunken bodies have reached temperatures between 700° and 750° C. Then the grate carries the hot shrunken bed through the cooling chamber in which a sufficient volume of a reducing gas flows through the bed and then to a heat-exchanger and back to the cooling chamber. When the bed is colder than about 200° C., the grate carries it to the discharge into a breaker which divides the discharge into the desired sizes of pieces of high density and strength.

A modification comprises mixing particles smaller than about 0.4 mm of a carbonaceous material low in volatile matter, such as coke fines or char or anthracite coal, with the coal particles smaller than about 0.2 mm in any desired proportion up to a weight ratio of about 60 to 40 and decreasing the extent of the oxygenation to near zero, or to zero.

Another modification comprises mixing the coal particles smaller than about 0.2 mm with limestone particles smaller than 0.4 mm and weighing so much that the contained $CaCO_3$ exceeds by about 10% stoichiometrically the sulfur content in the final coke of high density and strength. The mixture of the coal and the limestone particles is oxygenated to a lesser extent than the coal particles alone and is mixed with water and converted to high density coke. When such coke is burnt, the sulfur is trapped in the form of $CaSO_4$ which is intermingled with the ash.

The modification of the present invention comprises mixing coal particles smaller than about 0.2 mm without any oxygenation with particles smaller than about 0.4 mm of carbon-reducible oxide materials such as the oxidic ores of Fe, Mn, Cr and quartzite, and with particles smaller than about 0.4 mm of slag-forming additives if necessary, in the proportion of the oxides that after making self-reducing composites and smelting them in a submerged arc furnace, liquid iron, ferroalloys and silicon respectively are formed.

The proportion of the coal particles to the oxide particles is such that the compaction to bodies and their heat-treatment on the traveling grate result in self-reducing coke composites of coke-oxides which produce the desired iron, ferroalloy or silicon by smelting in a submerged arc furnace.

It is to be noted that the reduction of the oxides happens in quasi solid-state reactions before any fusion occurs.

This reduction technology prevents the fluctuation of the composition of the tapped products, improves the recovery of the end product, saves electric power and generates rather clean top gases of the arc furnace.

A modification of the smelting procedure comprises replacing the electric energy by the equivalent thermal energy generated by the partial combustion of coal dust and/or of a fluid fuel to at least a volume ratio of 60

$CO_2$/40 CO in a low shaft blast furnace into which the self-reducing composites of coke+carbon-reducible oxides have been fed. As the high partial pressure of $CO_2$ oxidizes a small part of the carbon in the tuyere zone, the loss is replaced at the start of the process by mixing the corresponding amount of coal particles smaller than 0.2 mm with the starting amount of this coal, and/or replacing the lost carbon by introducing fine grains of carbonaceous matter into the tuyere zone. It is understood that the combustion air may be preheated and/or oxygen-enriched. The tapped iron and ferroalloys may be treated in the ladle. The iron may be decarburized to a high grade steel without any tramp elements. Tapped ferrochrome may be decarburized while nickel is added to stainless steel.

A third method of smelting composites of coke+FeO or of composites of coke+FeO, $Cr_2O_3$ directly to steel or stainless steel involves the use of an open hearth furnace. In the case of making steel, self-reducing composites of coke+FeO, as made for smelting in the arc furnace, are charged into an open hearth furnace and heated therein by injecting fuel oil into the hot air coming from the checkers until the quasi solid-state reduction develops sufficient CO which combusts to $CO_2$ in the hot air. This heat melts the reduced bodies to iron and slag which collect on the bottom of the hearth. When the development of CO dies down, granular limestone and, if necessary, some more cooling agent such as iron and steel scrap free of harmful contaminants or self-reducing composites of coke+FeO are charged into the open hearth as charged in the beginning. Then oxygen is injected into the iron pool to oxidize carbon to CO, generating heat. The CO emerges from the charge and is combusted in the hot air generating more heat so that the entire content of the hearth is melted and the temperature is increased to the tapping level. The rate of the oxygen injection is gradually decreased when the specified content of carbon is approached and the injection is terminated when the specified content is reached as it has been done in the usual practice including the discharge of the hearth.

Making stainless steel directly comprises preparing self-reducing composites of coke+FeO, $Cr_2O_3$ which would result in the base metal of 18-8 stainless steel if smelted in a submerged arc furnace. However, in this process such composites are charged into the open hearth furnace in which the charge is heated as the composites for making carbon-steel. In the present process, a pool of ferrochrome collects on the bottom of the hearth.

When the development of CO by the reduction dies down, the hearth is charged with the proper amount of nickel-bearing material, compatible stainless steel scrap, granular limestone and self-reducing composites as charged at the start if other cooling material are not available. The oxygen is injected into the pool of ferrochrome to oxidize C to CO, generating heat. CO emerges from the charge and is combusted in the hot air to $CO_2$, generating heat. The total heat melts the entire content of the hearth and brings it to the discharge temperature of the stainless steel and slag. The rate of oxygen injection is diminished when a low carbon content is reached and completely terminated when the carbon is completely removed. As it had been done in the early practice of making stainless steel, particles of ferro-silicon are charged onto the slag in order to reduce chrome oxide back into the metal.

Alternatively, the metal pool may be partly decarburized in the open hearth and the content of the hearth then transferred to an oxygen converter for the finish by one of the recent methods.

It will be appreciated that the foregoing specification and Examples thereof are set forth by way of illustration and not limitation, and that various modifications and changes may be made therein without departing from the spirit and scope of the present invention.

I claim:

1. A process of continuously making pieces of formed composites of coke plus carbon reducible oxides of high density and strength which process included as an essential part of same the heat processing of compacted composite bodies on a traveling grate through a compartmentalized heating apparatus comprising a drying chamber, a carbonizing chamber consisting of a first pyrolyzing section and a second carbonizing section and a cooling chamber, comprising the following steps:

a. selecting at least one coal from bituminous or subbituminous or lignite coals in which the contents of ash and sulfur of coke made therefrom would be suitable for use in a blast furnace;

b. dividing the selected material into particles smaller than nominal about 0.2 mm;

c. mixing the divided particles from step b. with such an amount of particles smaller than about 0.4 mm of one or of a mixture of carbon-reducible oxide materials selected from the group consisting of iron ores, manganese ores, chromite ores, and quartzite that the final products of this process are hard pieces of self-reducing composites of coke plus oxides;

d. mixing the mixture of particles from step c. with such an amount of water that the later compression step f. of this claim squeezes out a small part of the added water;

e. aggregating the moist mixture by repeated pressing and stirring;

f. compressing the aggregates by means of smooth double rolls under a momentary maximum pressure in the range from about 800 to 1600 kg per square cm. whereby a small part of the added water from step d. is squeezed out and a continuous ribbon of about 5 cm. thickness is formed;

g. dividing the ribbon into single compacted bodies;

h. placing the bodies on a traveling grate to form a bed at least 30 cm deep;

i. moving the grate with the bed on it through the drying chamber of the heating apparatus during about 10 minutes and heating the bed to not higher than 220° C. when it leaves the drying chamber;

j. conducting the exhaust gases from step i. laden with steam to a stack or a heat exchanger;

k. moving the grate with the dehydrated bed into and through the first pyrolyzing section of the carbonizing chamber of the heating apparatus in which the bed is heated during at least 25 minutes to about 500° C. by gases coming from the carbonizing section of the carbonizing chamber of the heating apparatus and flowing upwards through the bed;

l. conducting the exhaust gases from step k. laden with volatile matter to equipment for washing and cooling to remove hydrogen sulfide and to separate the condensed volatile matter from the exhaust gases devoid of the hydrogen sulfide;

m. moving the grate and bed which is shrinking into and through the carbonizing section of the heating apparatus during at least 25 minutes in which the bodies continue to shrink by heating them from about 500° C. to at least between 700° and 750° C.;

n. introducing at the end of the second carbonizing section of the carbonizing chamber above the bed the hot gases of the complete combustion of a fluid fuel which flow down through the bed and heat it to the above maximum temperature and are conducted to the pyrolyzing section;

o. moving the grate and bed into and through the cooling chamber of the heating apparatus filled with a reducing gas which flows down and up through the bed, then to a heat exchanger and back to the cooling chamber;

p. moving the grate and bed when the latter has a temperature lower than about 200° C. out of the cooling chamber into the open air to discharge the bed from the grate; and q. discharging the bed into a breaker for dividing the self-reducing composites of coke plus oxides of high density and strength into pieces of the desired size.

2. A process according to claim 1 wherein in step i. the drying chamber consists of two sections and the grate and bed pass under an apron of flexible material which hangs from the ceiling of the drying chamber so that the loose lower edge of the apron slides over the bed when the latter moves through the first section during about 7 minutes during which time it is dried and then the grate and bed pass under a second apron into the second section and through which the bed on the grate travels during about 3 minutes and leaves the section at a temperature not higher than about 220° C.

3. A process according to claim 2 wherein the drying chamber is heated by the hot gases of the complete combustion of a fluid fuel introduced into the second section and drawn downwards through the bed and then blown upwards through the bed in the first section.

4. A process according to claim 1 wherein in step k. the grate and bed pass under an apron which separates the pyrolysis section from the drying chamber and in which pyrolysis section the bodies are heated by gases being blown upward through the bed coming from the carbonizing section.

5. A process according to claim 1 wherein in step m. the grate and bed pass under an apron which separates the pyrolysis section from the carbonizing section of the carbonizing chamber and during which heating step the shrinking of the bodies continues and the bodies are converted to composites of high density and strength.

6. A process according to claim 1 wherein in step o. the cooling chamber consists of two sections separated by an apron and the grate and coke composites pass under an apron separating the carbonizing chamber from the cooling chamber and cooled reducing gas is blown downward through the coke composites in the second section and upwards through the hot composites in the first section, whereupon the hot reducing gas is sent to the heat exchanger to utilize its sensible heat.

7. A process according to claim i wherein in step c. particles smaller than about 0.4 mm of slag-forming additives are also mixed with the divided coal particles from step b.

8. A process of operating a submerged arc furnace using composites made according to the process of claim 1 in which operation the composites are heated to a temperature sufficiently high that the endothermic quasi solid state reduction reaction of the carbon-reducible oxide material in the composites takes place before fusion of the composites occurs.

9. A process of operating a low shaft furnace which comprises feeding composites made according to the process of claim 1 to form a burden, heating the coke composites during their descent, reducing them due to quasi solid state reactions, melting the reduced bodies in the tuyere zone by the partial combustion of coal dust and/or a fluid fuel, forming flame gases which contain a partial pressure of $CO_2$ high enough to remove said excess of carbon, and tapping the obtained iron or ferroalloy.

10. A process according to claim 9 wherein the combustion air for the furnace is preheated and/or oxygen enriched.

11. A process of making steel directly in an open hearth which comprises charging hard self-reducing composites of coke-FeO made according to the process of claim 1 into the open hearth; heating them by injecting fuel oil into the flow of hot air coming from the checkers; combusting the carbon monoxide developed in the charge by the quasi solid state reduction of FeO in the hot air; decreasing to zero the injection of fuel oil with increasing combustion heat of CO to $CO_2$; continuing heating only by the combustion of CO to $CO_2$ until a pool of iron covered by slag is formed on the bottom of the hearth and until insufficient CO is formed by the reduction; charging granular limestone into the hearth and cooling material such as suitable scrap and/or composites of coke-FeO as used at the start; injecting oxygen into the iron pool whereby C is oxidized to CO, generating heat, and the emerged CO is oxidized to $CO_2$ in the hot air above the charge, generating more heat; melting the entire content of the hearth and increasing the temperature to the final degree; decreasing the rate of the oxygen injection down to zero when the specified content of carbon is reached; and removing steel and slag from the open hearth in the usual manner.

12. A process of making 18-8 stainless steel from hard self reducing composites of coke-FeCr oxides in an open hearth by the following steps: making hard self-reducing composites of coke-Fe, Cr oxides according to claim 1 in such a composition that they would produce a ferroalloy containing about 20.6% Cr and 75% Fe if they are smelted in a submerged arc furnace; charging them into an open hearth and heat-treating them therein until the time when the development of CO by the quasi solid state reactions ends; then charging the open hearth with granular limestone, and with the proper amount of nickel-bearing material, and with compatible scrap of stainless steel and/or with pieces of the self reducing coke composites as charged at the start of this process; then injection oxygen into the metal pool whereby formation of CO generates heat and the combustion of the CO above the charge in the hot air to $CO_2$ generates more heat so that the solid materials melt and react and the temperature of metal and slag rises to the level of tapping while the refining proceeds and the rate of injecting oxygen is gradually decreased until stopping it when the carbon is removed.

13. A process according to claim 12 wherein chrome oxide is recovered from the slag by introducing ferrosilicon into the hearth.

14. High density and strength pieces of composites of coke plus carbon reducible oxides made according to the process of claim 1.

* * * * *